United States Patent [19]

Deguchi et al.

[11] Patent Number: 4,818,568

[45] Date of Patent: Apr. 4, 1989

[54] HOT DIP COATED STEEL SHEET AND PROCESS FOR PRODUCING THE SAME

[75] Inventors: Takenori Deguchi, Shisui; Masaru Suzuki, Izumisano; Sanae Watanabe, Matsudo; Kazuko Uchida, Funabashi, all of Japan

[73] Assignee: Nisshin Steel Co., Ltd., Tokyo, Japan

[21] Appl. No.: 100,414

[22] Filed: Sep. 24, 1987

Related U.S. Application Data

[62] Division of Ser. No. 49,693, Apr. 17, 1987.

[30] Foreign Application Priority Data

Aug. 29, 1985 [JP] Japan ..... 60-190560
Aug. 30, 1985 [JP] Japan ..... 60-191773

[51] Int. Cl.[4] ..... C23C 2/26
[52] U.S. Cl. ..... 427/226; 427/376.8; 427/433; 427/406
[58] Field of Search ..... 428/632; 427/226, 433, 427/229, 406

[56] References Cited

U.S. PATENT DOCUMENTS 1,370,967 3/1921 Hommel ..... 427/229
2,328,101 8/1943 Rosenblatt ..... 427/229
4,663,245 5/1987 Yoshida ..... 428/632

OTHER PUBLICATIONS

Patent Publication No. 51-30539, 3/15/76, Japan, Kokai.
Patent Publication No. 52-152834, 12/19/77.

*Primary Examiner*—Sam Silverberg
*Attorney, Agent, or Firm*—Foley & Lardner, Schwartz, Jeffery, Schwaab, Mack, Blumenthal & Evans

[57] ABSTRACT

Disclosed is a hot dip coated steel sheet obtained by hot dipping a steel sheet in a hot-dip metal bath comprising zinc-based or zinc/aluminum based alloy, and a process for producing the same.

The hot dip coated steel sheet has a film of oxides which are compounds of cobalt or iron, or both of these, with oxygen, and the film can prevent the hot dip coated steel sheet from undergoing color change into grayish black in the case where spangles are minimized, where a coating contains corrosion resistance-improving elements such as magnesium and aluminum, or where a chromate treatment is applied after the mechanical processings were carried out.

Formation of oxide film on the surface of the hot dip coated steel sheet is carried out by a method in which an aqueous solution obtained by dissolving a salt of cobalt or a salt of iron or both of these is sprayed on the surface of a coating of the steel sheet when the temperature of the coating is 170° C. or higher. The salt is preferably a nitrate or a chloride for both the salt of cobalt and the salt of iron.

14 Claims, No Drawings

HOT DIP COATED STEEL SHEET AND PROCESS FOR PRODUCING THE SAME

This is a division of application Ser. No. 049,693 filed Apr. 17, 1987.

TECHNICAL FIELD

This invention relates to a hot dip coated steel sheet, coated with zinc-based or zinc/aluminum-based alloy, which is provided with a metal oxide film formed on the surface of a coating so that the surface of the coating may hardly undergo a color change into grayish black even when spangles are minimized or a chromate film is formed on the surface.

BACKGROUND ART

As the hot dip coated steel sheets comprising a zinc-based coating, there are known, in addition to the ordinary ones whose coating contains Al added in a very small amount for the purpose of inhibiting the growth of an alloy layer in the coating, those in which an element for improving corrosion resistance is added thereto, for example, those in which the coating comprises 4 to 53% of Al, 0 to 0.5% of Mg, 0.002 to 0.3% of Pb and the balance of Zn and inevitable impurities. As the hot dip coated steel sheets, coated with zinc-/aluminum-based alloy, there are known those in which the coating comprises 0.1 to 0.3% of Al, 0 to 0.5% of Mg, 0 to 10% of Si, 0.002 to 0.3% of Pb and the balance of Zn and inevitable impurities. These hot dip coated steel sheets are usually continuously produced through the steps of heating reduction of a steel belt, dipping of the belt into a hot-dip metal bath and regulation of the coverage. However, in order to improve appearance, flatness, formability, etc., it is often carried out that spangles are minimized by spraying water on the coating while that formed is still in the unsolidified state immediately after the step of regulating the coverage, or that various mechanical treatment processings, for example, buffing, levelling and skin pass rolling treatments are applied after the coating has been solidified.

However, of those in which the spangles are minimized, or, even in the case of regular spangles, those which are obtained by processing in a hot-dip metal bath of zinc-based alloy or a zinc/aluminum-based alloy with additional elements such as Mg, or those in which mechanical treatment processings are further applied thereto to make chromate treatment for the purpose of improving the corrosion resistance or the paint film adherence, the surfaces are subject to color change into grayish black (hereinafter referred to as "blackening") in a relatively short period of several months even stored under ordinary conditions, thereby losing the appearance of silver white.

This blackening is presumed to be caused by changes in the state of elemental distribution or the crystal orientation on the surface of a coating, due to the treatment for minimizing spangles or the mechanical treatment processings, to form a film (an oxide layer mainly composed of Al, Cr and Zn) which is liable to absorb light, said film having a blacky appearance. This blackening becomes extreme particularly when a chromate treatment has been applied. Therefore, in order to lessen or make quiet the blackening, a post-treatment may be carried out in a non-chromate system. However, such post-treatment in the non-chromate system results in high cost for the treatment.

On the other hand, as a process which can prevent the blackening even when the chromate treatment has been applied for the post-treatment, there is known a process in which a coating is treated, after the mechanical treatment processings and before the chromate treatment, with an acidic aqueous solution of pH 1 to 4 or an alkaline aqueous solution of pH 11 to 13.5 containing Ni ions or Co ions or ions of both of these (as disclosed in Japanese unexamined patent publication No. 177381/1984). According to this process, although more inexpensive than the post-treatment of the non-chromate system, it is required to provide an additional treatment tank anterior to a chromate treatment tank, and also, since the treatment solution is strongly acidic or strongly alkaline, a washing tank is needed to wash out the solution. Thus, equipment cost becomes high and also the steps are made complicated.

Also, this process can prevent the blackening by deposition of Ni or Co on the surface of an active coating in the form of metals or oxides. However, since the deposition taking place here is effected by the displacement plating, the adhesion of the deposited metals or oxides is weak. Accordingly, the deposits are readily removed to cause the blackening on the removed face in the shape of spots, streaks or stripes, if slippage occurs between sheets when the steel sheet is wound into a coil, or when cut sheets are overlapped, handled or transported, or if friction is applied by roll forming, pressing or bending processings.

Further, if the aqueous solution, which is strongly acidic or strongly alkaline as mentioned above, is not sufficiently washed after the treatment, the remaining acid or alkali may be a factor for corrosion to cause the blackening or corrosion or the development of white rust on the contrary, or to cause the formation of local cells between Zn and the deposited Ni or Co, resulting in the microscopic corrosion.

This invention provides a hot dip coated steel sheet comprising a stable, blackening-preventive film toughly formed on the surface of a coating, and a process for producing the hot dip coated steel sheet, which makes it possible to form inexpensively and toughly the film on the surface of a coating.

DISCLOSURE OF THE INVENTION

This invention prevents the blackening by forming a film of oxides of cobalt or iron, or both of these, on the surface of a hot dip coated steel sheet whose coating is comprised of zinc-based or zinc/aluminum-based alloy. The formation of the oxide film is carried out, after subjecting a steel sheet to hot dipping of zinc-based or zinc/aluminum-based alloy, by regulating the coverage and thereafter spraying an aqueous solution containing a salt of cobalt or a salt of iron, or both of these, on the surface of a coating while the coating is kept at a temperature of 170° C. or higher or after the coating is heated to 170° C. or higher, to effect thermal decomposition of the salt.

BEST MODE FOR WORKING THE INVENTION

The Japanese unexamined patent publication mentioned before discloses a process in which a hot dip, zinc-based alloy coated steel sheet is treated with an aqueous solution containing Co ions, whereupon oxides of Co are deposited. However, since the oxides mentioned in this process are those having been formed by the displacement plating, the oxides are not the compounds reacted with oxygen, but the compounds in which the valence of a metal increased, and thus they are different from the oxide film according to this invention. The film of oxides according to the invention is comprised of a compound reacted with oxygen, such as, in the case of Co for example, $Co_3O_4$, CoO or spinel type $CoAl_2O_4$, which is chemically stable enough to act as a barrier to protect the coating for a long period of time, thereby inhibit the formation or growth of a blackened film composed mainly of $ZnO_2$ and containing $Al_2O_3$, $Cr_2O_3$, $MgAl_2O_4$, etc.

The coating quantity on the oxide film should be controlled to be 1 to 100 mg/m$^2$ calculated in terms of metal cobalt or iron. If it is less than 1 mg/m$^2$, the blackening preventive effect is insufficient. If it exceeds 100 mg/m$^2$, the film will be colored.

A chromate film may be formed on the oxide film in order to further surely prevent the blackening and impart the paint film adherence to the film. If the oxide film is present, the blackening never proceeds contrary to the conventional case, even if the chromate film is formed.

The blackening is not effectively prevented or an adverse effect will be exhibited, if the oxides comprise other metals such as Ni, Zn, Ti, W and Nb.

The formation of the oxide film on the surface of a coating is carried out by keeping or adjusting the temperature of a coating to a temperature higher than the temperature at which a salt of cobalt or a salt of iron can effectively undergo the thermal decomposition in a short time, i.e., 170° C. or higher, and then spraying on the coating an aqueous solution containing the salt to effect the decomposition of the salt. If the salt is a nitrate or the like, the thermal decomposition takes place even at about 20° C. to form oxides, but such a low temperature may lower the efficiency of the thermal decomposition.

The spraying of the aqueous solution may be carried out either while the coating is kept at 170° C. or higher after the step of regulating the coverage in the production of a hot dip coated steel sheet, or by heating to 170° C. or higher a hot dip coated steel sheet once having been cooled after its production. In particular, it is very convenient if the spraying is carried out at the stage where a coating is still in the unsolidified state, since oxides of cobalt or iron produced by the thermal decomposition are dispersed in the surface of a coating to be made integral with the coating, whereupon a tough oxide film is formed on the surface of the coating and also spangles are uniformly minimized because of salts acting as nuclei of them. When spangles are minimized, it has bee known even in conventional arts to add a minimized spangle-forming agent such as phosphates and sodium chloride to an aqueous solution. In this invention, however, the salt of cobalt or the salt of iron can also play a role as the minimized spangle-forming agent. It is also possible to mix the conventional minimized spangle-forming agent together with these salts. By spraying an aqueous solution of a salt in the manner mentioned above, the oxide film is melt adhered or firmly sticked to the surface of a coating, and may not be readily removed or melted even when the mechanical treatment processing such as leveling or skin passing rolling or the chromate treatment is applied on the resultant steel sheet.

Further, the aqueous solution may be left as it was sprayed, and no washing out thereof is required. Accordingly, a continuous hot dipping equipment presently used may be additionally provided with only a spraying device.

The salt preferably includes nitrates and chlorides. This is because other salts such as acetates, sulfates and fluorides, although they can form a metal oxide film, do not show a satisfactory blackening preventive effect. Moreover, they are chemically unstable and tend to be readily melted out, and also an unreacted residual product or decomposed product may act as a corrosion factor to inhibit the blackening resistance.

There is no limitation in the concentration of the salt of cobalt or the salt of iron in the aqueous solution, the temperature of the aqueous solution, etc., but it is preferable to control the salt concentration to 0.1 to 20 g/lit. in terms of ion concentration. The reason therefor is as follows: If the metal ion concentration is less than 0.1 g/lit., the amount of the metal oxide formed on the surface of a coating is so minute that the blackening preventive effect may become small and also that, when spangles are to be minimized by spraying the aqueous solution to the coating having not yet been solidified, it may become impossible to achieve uniform minimization, and, if it exceeds 20 g/lit., a color inherent to molten salts comes out to color the whole area of the surface, although the blackening preventive effect can be improved.

The pH of the aqueous solution should be adjusted to 5 or 7, different from the pH in the process dsclosed in the above-mentioned Japanese unexamined patent publication. This is because, if the pH is too low or too high, the solution is instantaneously reacted with the coating because of the high temperature of the coating, thereby causing etching or microscopic corrosion on it, resulting in not only the change in color but also the corrosion. When a salt or chloride of cobalt is used as the salt, it may be dissolved in water so as to give 0.1 to 20 g/lit. of cobalt ion concentration, whereby the pH is turned to be of 5 to 7 which is of from weakly acidic side to neutral side and thus it is made possible to use the solution as it is without particularly adjusting the pH.

The treatment solution used when a chromate film is formed on the oxide film includes most preferably a solution in which chromic anhydride is mainly dissolved to have such composition as being $Cr^{3+}/(Cr^{3+}+Cr^{6+})=0$ to 0.6. The chromate treatment solution in which $Cr^{3+}$ and $Cr^{6+}$ are composed like this is a known chromate treatment solution (such as a reaction type chromate treatment solution, a coating type chromate treatment solution and an electrolytic chromate treatment solution). However, in the case of this invention, there may be some problems if such treatment solution is used as it is. This is because a reaction accelerating agent or an etching component to appropriately etch the zinc surface are added to almost all of the known chromate treatment solution, whereby zinc is melted to make the metal oxide film liable to be removed, resulting in lowering the blackening preventive effect. For this reason, it is preferable to use, as the chromate treatment solution, those which do not contain any etching component constituted of anions such as $F^-$, $Cl^-$, $SO_4^{2-}$, $NO_3^-$, $PO_4^{3-}$, $CH_3COO^-$ and oxalate anions. Additionally speaking, it is possible to add to the aqueous solution such compounds that may not melt the zinc surface or the metal oxide film (for example, $Al_2O_3$, $SiO_2$, etc.) regardless of whether they are inorganic or organic.

EXAMPLE 1

Steel sheets were subjected to hot dipping with use of a hot-dip metal bath comprising, in % by weight, 0.17% of Al, 0.30% of Pb, 0.03% of Fe and the balance being Zn and inevitable impurities, and thereafter the plating coverage was regulated to 200 to 250 g/m$^2$ by a gas wiping method, and then an aqueous solution of a salt as shown in Table 1 was sprayed on each of the steel sheets with use of compressed air of 2 to 3 kg/cm$^2$ to produce hot dip zinc coated steel sheets. Thereafter, part of these steel sheets was dipped in an aqueous solution of chromic acid anhydride, containing 20 g/lit. of $CrO_3$ and kept at a temperature of 40° C., for 5 seconds to effect a chromate treatment.

Next, from these non-chromate treated hot dip zinc coated steel sheets and the chromate treated ones, test pieces were collected and were allowed to stand for 30 days in an atmosphere of a temperature of 50±1° C. and a relative humidity of 98% to carry out accelerated blackening tests. Results of the accelerated tests are shown in Table 2.

Judgement on the blackening was in accordance with the following standard:

A: No blackening occurred.

B: Very faintly gray colored.

C: Less than 30% of the total area was blackened.

D: 30% or more of the total area was blackened.

TABLE I

| No. | Aqueous solution: Co or Fe salt | Content (g/lit) | pH | Temperature of coating at the start of spraying (°C.) |
|---|---|---|---|---|
| | Process of this invention: | | | |
| 1 | $Co(NO_3)_2.6H_2O$ | 5 | 6.0 | 470 |
| 2 | " | 5 | 6.0 | 470 |
| 3 | " | 5 | 6.0 | 170 |
| 4 | " | 0.5 | 6.8 | 420 |
| 5 | $Fe(NO_3)_3.9H_2O$ | 10 | 5.0 | 420 |
| 6 | " | 10 | 5.0 | 420 |
| 7 | " | 10 | 5.0 | 170 |
| 8 | $CoCl_2$ | 5 | 6.0 | 420 |
| 9 | $FeCl_3$ | 20 | 6.3 | 470 |
| 10 | $Co(NO_3)_2.6H_2O$ | 5 | 5.7 | 470 |
| | $CoCl_2$ | 5 | | |
| 11 | $Co(NO_3)_2.6H_2O$ | 10 | 4.8 | 420 |
| | $Fe(NO_3)_3.9H_2O$ | 10 | | |
| 12 | $CoSO_4$ $6H_2O$ | 10 | 6.0 | 420 |
| 13 | $(CH_3COO)_2Co.4H_2O$ | 10 | 6.2 | 420 |
| 14 | $FeSO_4$ | 10 | 6.3 | 200 |
| | Conventional process: | | | |
| 15 | Water only | — | 7.0 | 470 |
| 16 | Water only | — | 7.0 | 470 |
| 17 | Natural air cooling | | | — |

TABLE 2

| No. | Adhesion amount of Co, Fe in oxide film (mg/m$^2$) | Amount of Cr in chromate film (mg/m$^2$) | Accelerated blackening test: 1 day | 30 days | Spangles |
|---|---|---|---|---|---|
| | Process of this invention: | | | | |
| 1 | Co 30 | — | C | — | Minimized |
| 2 | Co 30 | 20 | — | A | Minimized |
| 3 | Co 26 | 19 | — | A | Regular |
| 4 | Co 1.3 | 18 | — | A | Regular* |
| 5 | Fe 50 | — | C | — | Regular* |
| 6 | Fe 50 | 30 | — | A | Regular* |
| 7 | Fe 52 | 15 | — | A | Regular |
| 8 | Co 26 | 19 | — | A | Regular* |
| 9 | Fe 95 | 21 | — | A | Minimized |
| 10 | Co 52 | 20 | — | A | Minimized |
| 11 | Co 30 Fe 30 | 20 | — | A | Regular* |
| 12 | Co 32 | 20 | — | C | Regular* |
| 13 | Co 47 | 23 | — | C | Regular* |
| 14 | Fe 33 | 19 | — | C | Regular |
| | Conventional process: | | | | |
| 15 | 0 | — | D | — | Minimized |
| 16 | 0 | 17 | — | D | Minimized |
| 17 | 0 | 21 | — | D | Regular |

*(small)

EXAMPLE 2

Steel sheets were subjected to hot dipping in plating baths having the composition as shown in Table 3, and, after regulating the coverages, aqueous solutions in which 5 g/lit. of $Co(NO_3)_2.6H_2O$ were dissolved or aqueous solutions in which 10 g/lit. of $Fe(NO_3)_3.9H_2O$ were dissolved were sprayed on the steel belts. Thereafter, chromate treatment was carried out in the same manner as in Example 1 to produce hot dip coated steel belts.

Next, test pieces were collected from these hot dip coated steel sheet, and allowed to stand for 30 days in an atmosphere of a temperature of 50±1° C. and a relative humidity of 98% or more to carry out accelerated blackening tests. Results of the accelerated tests are shown in Table 4. Judgement on blackening was made according to the same standard as in Example 1.

TABLE 3

| No. | Composition of hot-dip metal bath: Al | Mg | Si | Pb | La | Ce | Zn | Aqueous solution |
|---|---|---|---|---|---|---|---|---|
| | Process of this invention: | | | | | | | |
| 1 | 0.3 | 0.5 | 0.2 | 0.3 | 0 | 0 | Bal. | Co solution |
| 2 | " | " | " | " | " | " | Bal. | Fe solution |
| 3 | 4.1 | 0 | 0.2 | 0.002 | 0 | 0 | Bal. | Co solution |
| 4 | " | " | " | " | " | " | Bal | Fe solution |
| 5 | 5.0 | 0.1 | 0 | 0.005 | 0.005 | 0.001 | Bal. | Co solution |
| 6 | 5.0 | 0.3 | 1.0 | 0.2 | 0 | 0 | Bal. | Fe solution |
| 7 | 14 | 0.1 | 1.3 | 0.3 | 0 | 0 | Bal. | Co solution |
| 8 | " | " | " | " | " | " | Bal. | Fe solution |
| 9 | 53 | 0.1 | 0 | 0.003 | 0 | 0 | Bal. | Co solution |
| 10 | 56 | 0.3 | 0 | 0.15 | 0 | 0 | Bal. | Fe solution |
| | Conventional process: | | | | | | | |
| 11 | 0.3 | 0.5 | 0.2 | 0.3 | 0 | 0 | Bal. | Natural air-cooling |
| 12 | 4.1 | 0 | 0.2 | 0.002 | 0 | 0 | Bal. | Water only |
| 13 | 5.0 | 0.3 | 1.0 | 0.2 | 0.005 | 0.001 | Bal. | Natural air-cooling |
| 14 | 14 | 0.1 | 1.3 | 0.3 | 0 | 0 | Bal. | Natural air-cooling |
| 15 | 53 | 0.1 | 0 | 0.003 | 0 | 0 | Bal. | Water only |

TABLE 4

| No. | Temperature of coating at the start of spraying (°C.) | Amount of Co—, Fe— adhesion in oxide layer (mg/m$^2$) | Accelerated blackening test (30 days) | Spangles |
|---|---|---|---|---|
| | Process of this invention: | | | |
| 1 | 370 | Co 29 | A | Regular* |
| 2 | 190 | Fe 47 | A | Regular |
| 3 | 470 | Co 31 | A | Minimized |
| 4 | 470 | Fe 42 | A | Minimized |
| 5 | 240 | Co 32 | A | Regular |
| 6 | 320 | Fe 53 | A | Regular |

TABLE 4-continued

| No. | Temperature of coating at the start of spraying (°C.) | Amount of Co—, Fe— adhesion in oxide layer ($mg/m^2$) | Accelerated blackening test (30 days) | Spangles |
|---|---|---|---|---|
| 7 | 180 | Co 34 | A | Regular |
| 8 | 410 | Fe 45 | A | Regular* |
| 9 | 470 | Co 28 | A | Minimized |
| 10 | 470 | Fe 50 | A | Minimized |
| | | Conventional process: | | |
| 11 | — | 0 | D | Regular |
| 12 | 470 | 0 | D | Minimized |
| 13 | — | 0 | D | Regular |
| 14 | — | 0 | D | Regular |
| 15 | 470 | 0 | D | Minimized |

*(small)

POSSIBILITY OF INDUSTRIAL UTILIZATION

This invention can be utilized not only when a hot dip coated steel sheet, coated with zinc-based or zinc-/aluminum-based alloy, is produced, but also when the hot dip coated steel sheet is blackened because of cutting or processing of a member after the production.

We claim:

1. A process for producing a hot dip coated steel sheet, comprising the steps of:

subjecting a steel sheet to hot dipping of zinc-based or zinc/aluminum-based alloy, thereafter regulating the coverage, then spraying an aqueous solution containing a salt of cobalt or a salt of iron, or both of these, on the surface of a coating while the coating is kept at a temperature of 170° C. or higher or after the coating is heated to 170° C. or higher, to effect thermal decomposition of the salt, and forming a film consisting essentially of of oxides of cobalt or iron, or both of these, on the surface of the coating.

2. The process for producing a hot dip coated steel sheet according to claim 1, wherein the salt of cobalt is cobalt nitrate.

3. The process for producing a hot dip coated steel sheet according to claim 1, wherein the salt of cobalt is cobalt chloride.

4. The process for producing a hot dip coated steel sheet according to claim 1, wherein the salt of iron is ferric nitrate.

5. The process for producing a hot dip coated steel sheet according to claim 1, wherein the salt of iron is ferric chloride.

6. The process for producing a hot dip coated steel sheet according to claim 1, wherein, as the aqueous solution, an aqueous solution having the pH of 5 to 7 is sprayed.

7. The process for producing a hot dip coated steel sheet according to claim 1, wherein, after the aqueous solution is sprayed and the decomposition of the salt is effected, the surface of the coating is treated with a chromate treatment solution.

8. The process for producing a hot dip coated steel sheet according to claim 7, wherein, used as the chromate treatment solution is a solution in which chromic anhydride is mainly dissolved to have such composition as being $Cr^{3+}/(Cr^{3+}+Cr^{6+})=0$ to 0.6, and $F^-$, $Cl^-$, $SO_4^{2-}$, $NO_3^-$, $PO_4^{3-}$, $CH_3COO^-$ and oxalate anions are not contained.

9. The process for producing a hot dip coated steel sheet according to claim 2, wherein, as the aqueous solution, an aqueous solution having the pH of 5 to 7 is sprayed.

10. The process for producing a hot dip coated steel sheet according to claim 3, wherein, as the aqueous solution, an aqueous solution having the pH of 5 to 7 is sprayed.

11. The process for producing a hot dip coated steel sheet according to claim 4, wherein, as the aqueous solution, an aqueous solution having the pH value of 5 to 7 is sprayed.

12. The process for producing a hot dip coated steel sheet according to claim 5, wherein, as the aqueous solution, an aqueous solution having the pH of 5 to 7 is sprayed.

13. A process according to claim 1, wherein after formation of the zinc-based coating it is kept in the unsolidified state at a temperature of 170° C. or higher during deposition of the metal oxide.

14. A process according to claim 13, consisting essentially of the recited steps.

* * * * *